US005192344A

United States Patent [19]

House

[11] Patent Number: 5,192,344

[45] Date of Patent: Mar. 9, 1993

[54] WET FILTER VACUUM CLEANER

[75] Inventor: Ronald J. House, Bixby, Okla.

[73] Assignees: Andre E. Thorn Bacon; Sydney J. Thorn Bacon, both of Bixby, Okla. ; a part interest

[21] Appl. No.: 757,661

[22] Filed: Sep. 10, 1991

[51] Int. Cl.[5] ..... B01D 47/00

[52] U.S. Cl. ..... 55/216; 55/255; 55/256

[58] Field of Search ..... 55/255, 256, 216

[56] References Cited

U.S. PATENT DOCUMENTS

| | | | |
|---|---|---|---|
| 2,250,226 | 7/1941 | Juelson | 55/255 |
| 2,954,095 | 9/1960 | Brock | 55/255 |
| 3,812,658 | 5/1974 | Arnold | 55/248 |
| 4,300,924 | 11/1981 | Coyle | 55/255 |
| 4,894,881 | 1/1990 | Palmer et al. | 55/216 |

FOREIGN PATENT DOCUMENTS

| | | | |
|---|---|---|---|
| 588379 | 2/1930 | Fed. Rep. of Germany | 55/248 |
| 543412 | 9/1922 | France | 55/256 |
| 702126 | 3/1931 | France | 55/255 |

*Primary Examiner*—Bernard Nozick

*Attorney, Agent, or Firm*—Head & Johnson

[57] ABSTRACT

A vacuum cleaner having a substantially cylindrical tank with a bottom, a cover which pneumatically closes the tank to define a vacuum chamber, an eccentric inlet and an outlet through the tank cover which define a pneumatic path through the chamber and a vacuum source for causing air flow along the path from a dry to a wet filter vacuum cleaner. A convex baffle, in the shape of an inverted shallow bowl with a rim of diameter somewhat less than the diameter of the tank is adapted to be approximately concentrically mounted in the tank above its bottom and has an eccentric aperture which is vertically aligned with the inlet when the baffle is properly situated in the tank. A tube is adapted at its upper end to be connected to the inlet and extend downwardly, snugly through the aperture. The lower face of the tube is cut at an angle other than 90° and optimally at approximately 45°. The lower face of the tube lies between the rim of the baffle and the bottom of the tank and faces substantially toward the center of the baffle. When the baffle and tube are properly mounted in the vacuum cleaner and the tank is filled with liquid to a level above the face of the tube and below the rim of the baffle.

15 Claims, 2 Drawing Sheets

WET FILTER VACUUM CLEANER

BACKGROUND OF THE INVENTION

This invention relates generally to vacuum cleaners and more particularly concerns improvements in dust filtration systems for vacuum cleaners.

My mother, who has suffered from respiratory problems such as asthma and allergies, has been unable to vacuum her own home because vacuuming generally stirs up dust to an extent which so aggravates her respiratory problems that she is unable to function.

In my efforts to relieve this problem, I have purchased and used most, if not all, of the different types of vacuum cleaners available on the market. None of them have solved the problem. I now own a collection of vacuum cleaners of no use to my mother whatsoever. Either I or someone else has to do her vacuuming while she leaves her own home or secludes herself in an area that has been painstakingly secured against the circulation of dust.

It is, therefore, an object of this invention to provide a vacuum cleaner which minimizes the circulation of dust in an area being vacuumed. Similarly, it is an object of this invention to provide a vacuum cleaner that significantly reduces the volume of dust recirculated to the air by the vacuum cleaner. It is also an object of this invention to provide a kit which can be used to reduce the volume of dust recirculated by an existing vacuum cleaner.

SUMMARY OF THE INVENTION

In accordance with the invention, an improvement is provided for use in combination with a vacuum cleaner having a substantially cylindrical tank with a bottom, a cover which pneumatically closes the tank to define the vacuum chamber, an eccentric inlet and an outlet through the tank cover which define a pneumatic path through the chamber and a vacuum source for causing air flow along that path. The improvement consists in part of a convex baffle, preferably in the shape of an inverted shallow bowl, which has a rim of diameter somewhat less than the diameter of the tank. The baffle is adapted to be approximately concentrically mounted in the tank above its bottom and has an eccentric aperture which is vertically aligned with the inlet when the baffle is properly situated in the tank. A tube is adapted at its upper end to be connected to the inlet and extend downwardly, snugly through the aperture. The lower face of the tube is cut at an angle other than 90° and optimally at approximately 45°. When properly mounted, the lower face of the tube lies between the rim of the baffle and the bottom of the tank and faces substantially toward the center of the baffle. When the baffle and tube are properly mounted in the vacuum cleaner and the tank is filled with liquid to a level above the face of the tube and below the rim of the baffle, the pneumatic flow path extends from the inlet, through the cover, through the tube, through the liquid covering the face of the tube, upwardly into the space above the water and within the baffle, out of the baffle and around its rim through an annular passage defined by the rim and the wall of the tank and finally through the outlet in the cover.

By use of this improvement on one of my collection of vacuum cleaners which already had been tried and failed, dust circulation was reduced to the extent that my mother is now able to do her own vacuuming. Furthermore, the interval between her vacuuming days is increased because the collection of dust in her home has been found to be greatly minimized.

BRIEF DESCRIPTION OF THE DRAWINGS

Other objects and advantages of this invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
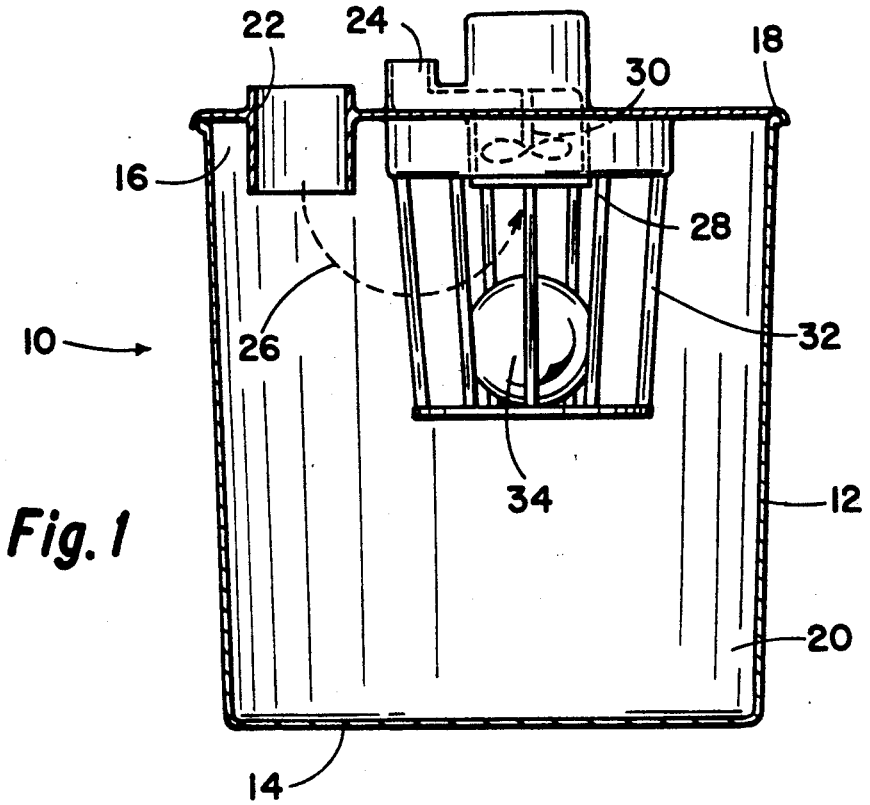
FIG. 1 is a side elevational view with parts broken away of a typical prior art vacuum cleaner.

Turning first to FIG. 1, a typical wet/dry vacuum cleaner presently available on the market is illustrated. The vacuum cleaner 10 consists of a substantially cylindrical tank 12 having a bottom 14, an open top 16 and a cover 18 which pneumatically closes the tank 12 to define a vacuum chamber 20.

The cover 18 has an eccentric vacuum inlet 22 and an exhaust outlet 24 which extend through the tank cover 18 to define a pneumatic path 26 from the exterior environment, through the chamber 20 and back to the exterior environment. Typically, this exhaust outlet 24 includes a circular opening 28 disposed within the tank 12 and a vacuum source 30 which provides the necessary suction to induce flow along the pneumatic path 26 through the opening 28 and the exhaust outlet 24.

In a typical arrangement such as the vacuum cleaner 10 shown, a cage 32 of a float valve contains a ball 34 which operates to prevent overflow within the tank 12 when the vacuum 10 is being used to collect liquids. The vacuum cleaner 10 also normally includes a dry filter (not shown) connected between the vacuum inlet 22 and the exhaust outlet 24.

Figure 2:
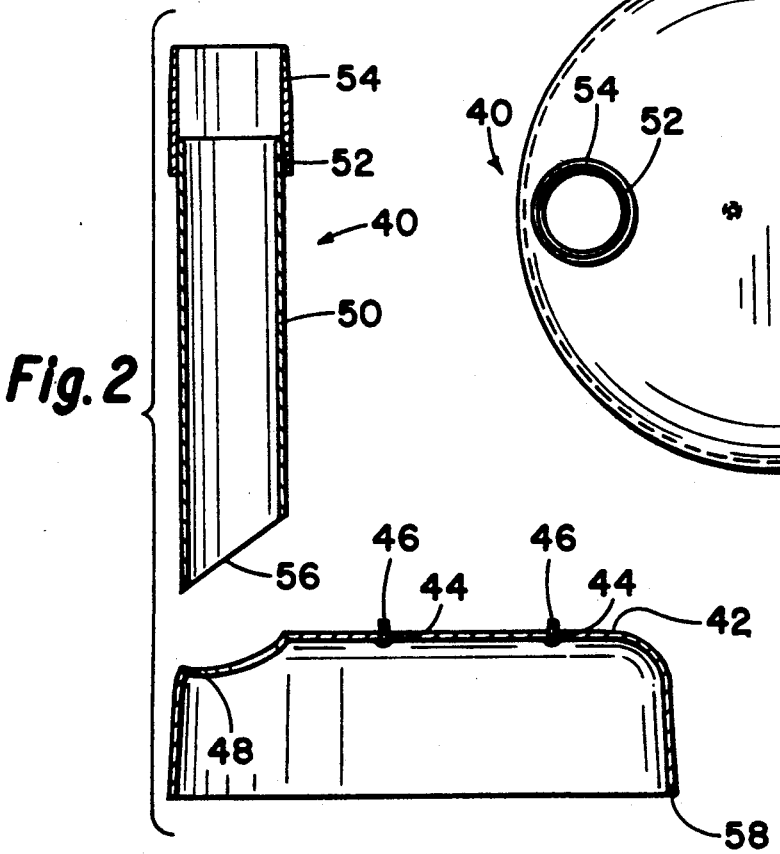
FIG. 2 is an exploded cross-sectional view of a preferred embodiment of the present improvement.
Figure 3:
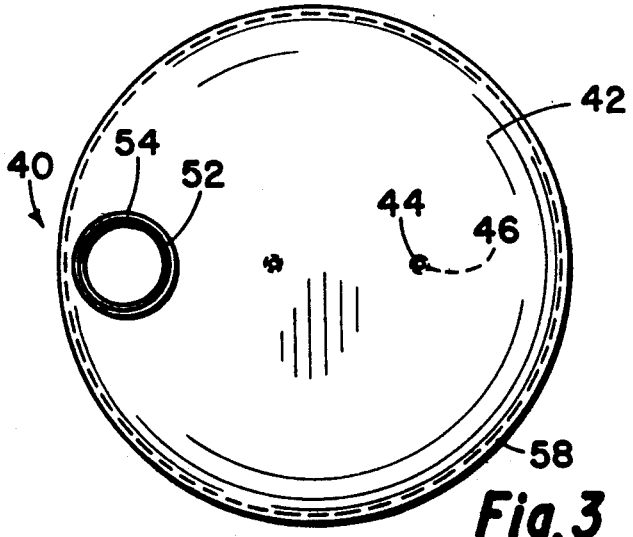
FIG. 3 is a top plan view of the improvement of FIG. 2.

Turning now to FIGS. 2 and 3 an improvement is illustrated for converting the dry filter vacuum cleaner 10 into a wet filter vacuum cleaner. The improvement 40 includes a convex baffle 42, preferably in the shape of an inverted shallow bowl, having a diameter somewhat less than the diameter of the tank 12. In the preferred embodiment shown, the baffle 42 includes holes 44 for receiving mounting screws 46 and an eccentric aperture 48. The improvement 40 also includes a tube 50 having an upper end 52 adapted to be pneumatically connected with the vacuum inlet 22 in the cover 18. As shown, connection is by the use of a coupling 54 having an exterior taper which may be snugly inserted into the vacuum inlet 22. The lower face 56 of the tube 50 is cut at an angle other than 90° in relation to the longitudinal axis of the tube 50 for reasons to be hereinafter discussed. The diameter of the tube 50 determines the diameter of the aperture 48 in the baffle 42. That is, the tube 50 fits snugly in the aperture 48.

Figure 4:
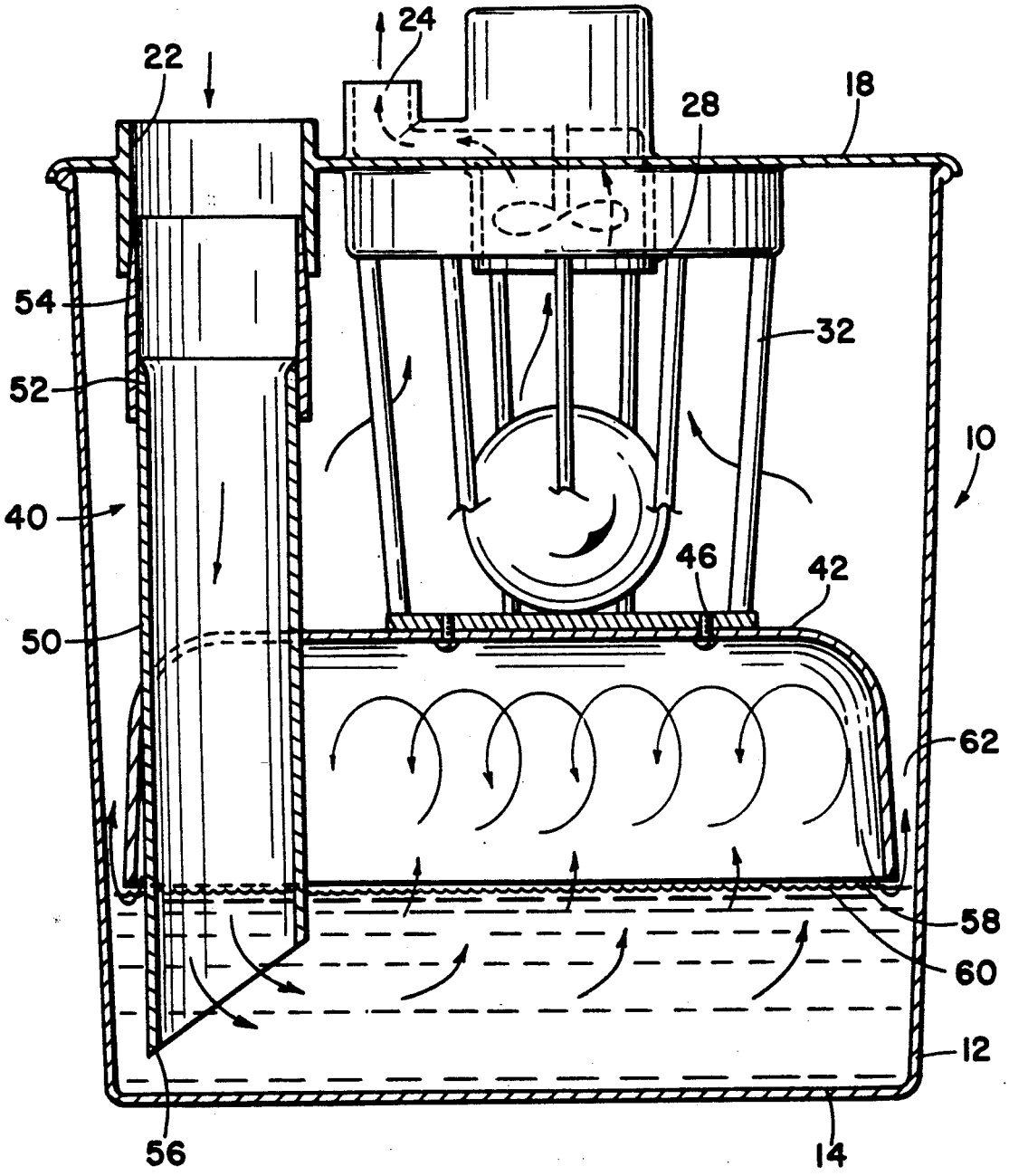
FIG. 4 is a side elevational view with parts broken away illustrating the improvement of FIGS. 2 and 3 mounted in the vacuum cleaner of FIG. 1.

Turning now to FIG. 4, the combination of the improvement 40 with the vacuum cleaner 10 is illustrated. The tube 50 is inserted into its snug position within the aperture 48 of the baffle 42 so that the lower face 56 of the tube 50 extends below the rim 58 of the baffle 42 and faces generally toward the center of the baffle 42. The upper end 52 of the tube 50 is connected to the vacuum inlet 22 either directly or by use of the coupling 54 as shown. Preferably, the upper portion of the coupling 54 if tapered for a snug fit into the inlet 22 and the upper rim of the tube 50 is beveled to provide a substantially smooth interior connection to the coupling 54 to minimize any interior shelf inside the coupling 54 that might tend to collect hair or other large particles that could restrict air flow into the tube 50. With the tube 50 downwardly extended into the tank 12 with the Vacuum inlet 22 and the aperture 48 in substantially vertical alignment, the screws 46 are inserted through the holes 44 in the baffle and secured to the cage 32 of the float valve.

The length of the tube 50 is such that, when it is connected to the vacuum inlet 22 and the cover 18 is seated on the tank 12, the cut lower face 56 of the tube 50 lies between the bottom 14 of the tank 12 and the rim 58 of the baffle 42. The diameter of the baffle 42 is selected such that it can lie substantially concentrically within the tank 12.

The operation of the vacuum cleaner 10 in combination with the improvement 40 can also best be understood in relation to FIG. 4. With the improvement 40 mounted on the cover 18 as above described and water or other liquid added to the tank 12 to a level 60 to be determined as hereinafter explained, the improvement 40 is inserted in the tank 12 until the cover 18 is fully seated on the tank 12. The water level 60 selected is such that, when the cover 18 is fully seated, the cut face 56 of the tube 50 is substantially fully inserted into the water but the water level 60 falls below the rim 58 of the baffle 42. It can readily be seen that the desired spacial relationships of the rim 58, the water level 60, the cut face 56 of the tube 50 and the bottom 14 of the tank 12 can be coordinated by choice of the length of the tube 50 and/or the water depth 60 and/or by the use of spacers (not shown) for positioning the baffle 42 at a selected height in relation to the cover 18 or the cage 32 of the cover 18.

For example, assuming a vacuum cleaner 10 of the type shown having a diameter of approximately 11½ inches and a depth of approximately 11½ inches, optimal performance of the combined vacuum cleaner 10 and improvement 40 is achieved when the water depth 60 is in the range of 1 to 1½ inches, the difference in diameter between the baffle 42 and the tank 12 is approximately 1 inch providing an approximately ½ inch annular gap 62 between the rim 58 and the tank 12 and the angle of the cut of the lower face 56 of the tube 50 is approximately 45°.

During operation, the pneumatic path between the vacuum inlet 22 and the exhaust outlet 24 is modified by the improvement 40 to extend from the inlet 22 through the tube 50 and its cut face 56, through the water or other liquid and upwardly from the liquid into the space defined by the water level 60 and the exterior of the baffle 42. Flow then continues around the edges of the rim 58 of the baffle through the annular gap 62 between the rim 58 and the tank 12 and then upwardly into the circular opening 28 through the exhaust outlet 24 to the atmosphere. If the water level 60 extends above the rim 58, the system will not work efficiently. Furthermore, if the water level 60 i too significantly below the rim 58 or does not sufficiently cover the cut face 56 of the tube 50, the system will not operate efficiently. Similarly, if the angle of the cut face 56 varies significantly from the approximately 45° relationship the efficiency of the device diminishes. Finally, if the annular gap 62 is varied significantly from the ½ inch relationship, the efficiency of the system diminishes. These variations in efficiency are thought to occur because too small an annular gap 62 restricts circulation, too large an annular gap 62 minimizes the circulatory area within the baffle 42, too great an angle on the cut face 56 permits the pneumatic flow to rise too quickly and too little an angular relationship in the cut face 56 causes pneumatic flow to be directed elsewhere than within the central confines of the baffle. It is also believed that when the various components are in a proper relationship, the pneumatic flow through the water or liquid level 60 results in a turbulent air flow within the confines of that space defined by the water level 60 and the baffle 42 so as to provide a constant recirculating mist within this space which more effectively removes dust from the liquid filtered air before its release around the rim 58 to the exhaust outlet 24.

It has been found that a tube 50 of approximately 1½ inches diameter of 3/16 inch PVC and a baffle 42 conforming approximately to the dimensions of the typical 11 inch desert bowl fixed to the cover or cage with stainless steel screws has produced a desirable result.

Whatever the reasons for its effectiveness, this combination of the improvement 40 with the vacuum cleaner 10 produces a significant reduction in the amount of dust recirculated by the unit to the atmosphere. Proper adjustment of the relationships above defined will be found to maximize the overall efficiency of the unit.

Thus, it is apparent that there has been provided, in accordance with the invention, a wet filter vacuum cleaner that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. In combination with a vacuum cleaner having a substantially cylindrical tank with a bottom, a cover pneumatically closing the tank to define a vacuum chamber, an eccentric inlet through the cover at a radius from the vertical axis of the tank, an outlet through the cover and water therein, apparatus comprising:

a convex baffle having a rim of diameter less than the diameter of the tank, an eccentric aperture disposed therethrough at said radius from an axis of said baffle and a lower edge disposed slightly above the water;

a tube extending snugly through said aperture and having a lower opening at an angle other than 90 degrees in relation to a longitudinal axis thereof facing substantially toward said axis of said baffle and entirely disposed slightly beneath the water; and means disposed on an upper end of said tube for connecting said tube to the inlet with said baffle substantially concentrically mounted in the tank with said aperture vertically aligned with the inlet.

2. The apparatus according to claim 1, said baffle diameter being approximately 1" less than said tank diameter.

3. The apparatus according to claim 1, said lower face being cut at an angle of approximately 45 degrees.

4. The apparatus according to claim 1, said baffle being adapted to be mounted with said rim being approximately 1½" above said tank bottom.

5. The apparatus to claim 1, said baffle having the shape of an inverted bowl.

6. The apparatus according to claim 1, said baffle having the shape of an inverted shallow bowl.

7. The apparatus according to claim 1, the depth of said baffle approximately 2" to 2½".

8. The apparatus according to claim 1, said aperture and said tube being approximately 1½" in diameter.

9. The apparatus according to claim 1 further comprising a coupling for connecting said tube to the inlet.

10. The apparatus according to claim 9, said tube having a beveled upper rim for providing a substantially smooth interior connection to said coupling.

11. In combination with a vacuum cleaner having a substantially cylindrical tank with a bottom, a cover pneumatically closing the tank to define a vacuum chamber, an eccentric inlet through the cover at a radius from the vertical axis of the tank, an outlet through the cover and water therein, apparatus comprising:

a bowl having a rim of diameter less than the diameter of the tank, an eccentric aperture disposed therethrough at said radius from an axis of said bowl and a lower edge disposed slightly above the water;

a tube extending snugly through said aperture and having a lower opening at an angle other than 90 degrees in relation to a longitudinal axis thereof facing substantially toward said axis of said bowl and entirely disposed slightly beneath the water, and means disposed on an upper end of said tube for connecting said tube to the inlet with said bowl invertedly and substantially concentrically mounted in the tank with said aperture vertically aligned with the inlet through said aperture with said face disposed between said rim of said bowl and the tank bottom.

12. In combination with a vacuum cleaner having a substantially cylindrical tank with a bottom, a cover pneumatically closing the tank to define a vacuum chamber, an eccentric inlet and an outlet through the cover into the chamber to define a pneumatic path, a vacuum source for causing air to flow along the path, a shut off valve for closing the outlet having a cage extending downwardly from the cover into the tank and water in the tank, apparatus comprising:

a bowl having a rim of diameter less than the diameter of the tank and an eccentric aperture therethrough, said bowl being invertedly and substantially concentrically mounted on the cage slightly above the water in the tank with said aperture vertically aligned with the inlet;

a tube having a lower opening cut at an angle other than 90 degrees in relation to a longitudinal axis thereof and connected to the inlet with said tube extending downwardly snugly through said aperture with said opening entirely disposed slightly beneath the water and opening substantially toward a center of said bowl.

13. In combination with a vacuum cleaner having a substantially cylindrical tank with a bottom, a cover pneumatically closing the tank to define a vacuum chamber and an eccentric inlet, an outlet through the cover and a vacuum source, apparatus comprising:

a convex baffle having a rim of diameter less than the diameter of the tank and an eccentric aperture therethrough, said baffle being substantially concentrically mounted in the tank above the bottom thereof with said aperture vertically aligned with the inlet; and a tube having a lower face cut at an angle other than 90 degrees in relation to a longitudinal axis thereof and an upper portion connected to the inlet with said tube extending downwardly snugly through said aperture with said face disposed between said rim of said baffle and the tank bottom and opening substantially toward a center of said baffle.

14. In combination with a vacuum cleaner having a substantially cylindrical tank with a bottom, a cover pneumatically closing the tank to define a vacuum chamber, an eccentric inlet and an outlet through the cover into the chamber to define a pneumatic path and a vacuum source for causing air to flow along the path, an improvement comprising:

a bowl having a rim of diameter less than the diameter of the tank and an eccentric aperture therethrough, said bowl being invertedly and substantially concentrically mounted in the tank above the bottom thereof with said aperture vertically aligned with the inlet; and a tube having a lower face cut at an angle other than 90 degrees in relation to a longitudinal axis thereof and connected to the inlet with said tube extending downwardly snugly through said rim aperture with said face disposed between said rim of said bowl and the tank bottom and opening substantially toward a center of said bowl.

15. A vacuum cleaner having a substantially cylindrical tank with a bottom, a cover pneumatically closing the tank to define a vacuum chamber, an eccentric inlet through the cover at a radius from the vertical axis of the tank and at a height above the bottom of the tank, an outlet through the cover and water in the tank, apparatus comprising:

convex baffle of diameter less than the diameter of the tank having an eccentric aperture disposed therethrough at said radius from an axis of said convex baffle; and a tube extending downwardly snugly through said eccentric aperture, said tube having a lower opening cut at an angle other than 90 degrees in relation to a longitudinal axis thereof facing substantially toward said axis of said convex baffle and means disposed on an upper end of said tube connecting said tube to the inlet with said convex baffle substantially concentrically mounted in the tank slightly above the water with said aperture vertically aligned with the inlet and with said opening being entirely disposed beneath the water and between said convex baffle and the tank bottom with relatively small spacing therebetween in relation to said height.

* * * * *